United States Patent [19]

Engebretsen

[11] Patent Number: 4,965,973

[45] Date of Patent: Oct. 30, 1990

[54] DEVICES FOR LOAD CARRYING STRUCTURES

[76] Inventor: Arne Engebretsen, 3515 Kroderen, Norway

[21] Appl. No.: 178,313

[22] Filed: Apr. 6, 1988

Related U.S. Application Data

[63] Continuation-in-part of Ser. No. 845,128, Feb. 4, 1986, abandoned.

[30] Foreign Application Priority Data

Jun. 22, 1984 [NO] Norway ..... 842533

[51] Int. Cl.[5] ..... E04C 3/26

[52] U.S. Cl. ..... 52/223 R; 52/642

[58] Field of Search ..... 428/537.1; 52/223 R, 52/640, 642, 223 L

[56] References Cited

U.S. PATENT DOCUMENTS 2,039,398 5/1936 Dye ..... 521/223 R X
2,601,910 7/1952 Nichols ..... 52/727
3,294,608 12/1966 Peterson ..... 52/225 R X
4,745,718 5/1988 O'Sullivan et al. ..... 52/223 R

FOREIGN PATENT DOCUMENTS 2531656 2/1977 Fed. Rep. of Germany .

*Primary Examiner*—Richard W. Chilcot, Jr
*Assistant Examiner*—Creighton Smith
*Attorney, Agent, or Firm*—Wigman & Cohen

[57] ABSTRACT

To improve the utilization of the volume of the material in the middle of the cross-section of load carrying construction, for example, laminated wooden beams, and to increase the stiffness and bending strength, combinations of structural components, such as laminated wooden beams and lamells, which are curved in presses while the components are assembled, may be used. After being removed from the presses, planned and permanent pre-stresses will be introduced into the entire construction units. Reinforcing components, such as steel, can also be used in combination with the above described methods of construction.

26 Claims, 7 Drawing Sheets

1
2
3
+
−

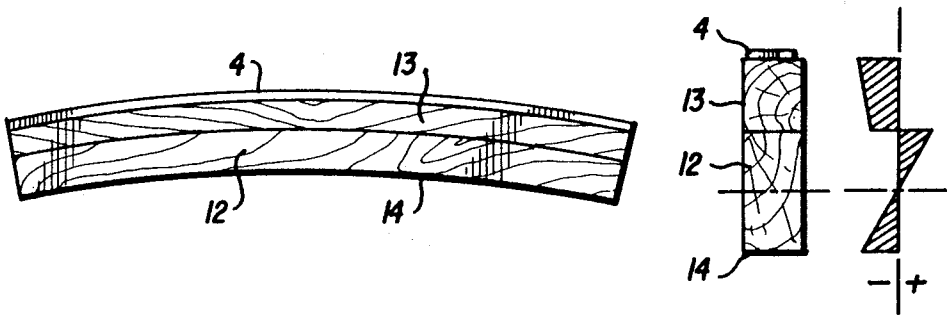
Fig. 4C
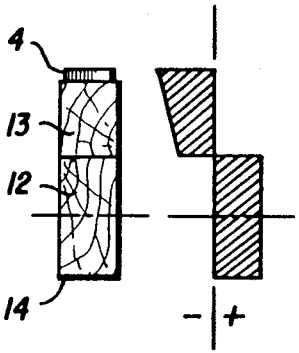
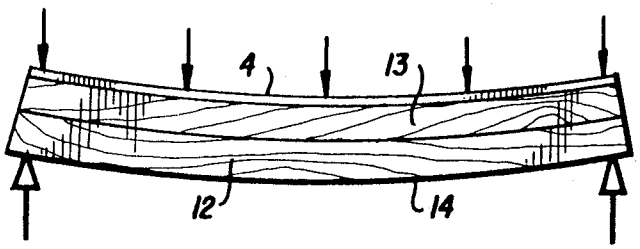
Fig. 4D
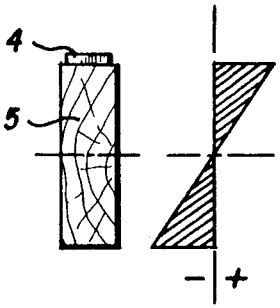
Fig. 5A
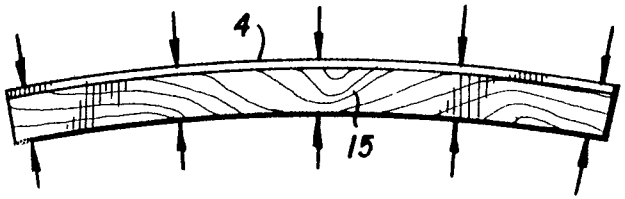

DEVICES FOR LOAD CARRYING STRUCTURES

CROSS REFERENCE TO RELATED APPLICATION

This is a continuation-in-part of co-pending U.S. application Ser. No. 845,128, filed Feb. 4, 1986.

BACKGROUND OF THE INVENTION

The present invention relates to devices for load carrying structures, consisting of laminated wood.

The general objective is to improve load carrying structures by increasing the utilization of the volume of the materials and to introduce pre-stressed forces.

Due to the lack of homogeneous strength and the natural dimensions of wooden materials, it is common to manufacture wooden beams by gluing together relatively slender, finger-jointed lamells. These types of beams are referred to as laminated beams and are produced in varying dimensions. Laminated beams obtain a high grade of homogeneous quality in the materials and consequently a high degree of allowable and real load carrying capacity These beams are ordinarily produced with a rectangular cross-section. This is an advantageous shape in case of fires. With reference to the strength of beams, the load bearing capacity depends on the ability to resist compression in the upper and tension forces in the lower part, while the shear forces in the middle of the section are relatively small. A rectangular cross-section is therefore not an ideal shape, because the material in the middle of the section is utilized only to a very small degree.

It is known that different beams have been made to imitate the usual metal beam section with a reduced material volume in the middle of the cross-section.

It is also known from different projects to improve wooden beams, that steel members have been installed in both the upper and lower parts.

The above-mentioned examples to improve wooden beam does not indicate that the desired, favorable results, have been reached, because wooden beams with the rectangular cross-section still tend to dominate the market.

SUMMARY AND OBJECTS OF THE INVENTION

The main object of the present invention is to improve load carrying constructions, particularly wooden beams, by introducing new methods which in an effective manner can improve load carrying capacity and/or stiffness, among other efforts, and also attaining better utilization of the total volume of the material.

The objectives will be achieved by introducing pre-stressed forces in the load carrying constructions. This is done when parts of constructions, for example straight or curved laminated parts, in a press, are bent (deformed) or are forced to receive increased or opposite curvatures and at the same time being assembled, for example, by the use of glue. Laminated wooden beams can also be curved in a press while a number of deformable lamells are being attached to the beam, by the use of glue. Stresses are imposed into the beams as they are bent in a press. While still in the press, these beams are mounted to other constructural parts, and permanent pre-stress forces are then introduced into the assembled constructural parts. Reinforcing structural components, such as steel, can also be installed in straight or curved beams, before or when the beams are bent in presses and there assembled with other structural components. These reinforcing components will be of considerable importance for the load carrying capabilities, distribution of stresses and stiffness, and will effectively alter the location of the neutral axis, to a more favorable position in order to obtain the most effective distribution of the stresses.

The pre-stressed forces in compression or tension, can be increased or decreased, or changed from compression to tension or opposite, when loads are applied to the beams. The strength and location of the reinforcing structural components will be important as to how the pre-stresses are introduced and also as to how these pre-stresses are affected by the stresses due to the loads the beams are intended to carry. As shown in the stress diagrams associated with the figures, the described construction methods will lead to a much better utilization of the material located in the middle of the cross-section of the beams.

The different methods of construction as described above, explaining how this invention solves the present problems involved, actually describes a new, flexible system, containing a number of technical factors which can be combined in many different variations in order to obtain the desirable qualities favorable to load carrying constructions in practical use.

In order to illustrate some of the many possible designs, several figures show examples of how different beams can be made in the laminated beam industry. The load carrying constructions in these examples will consist of laminated beam parts, reinforcing components, for example made of steel, and slender deformable wooden lamells.

The specified system can also be applied to design load carrying constructions in other industries where materials other than wood are used.

In the figures, arrows pointing to the upper and lower surfaces of the construction parts, indicate that these are placed in a press. Beams carrying loads are shown being supported at each end and the load being evenly distributed over the length of the beam.

Cross-sections and stress diagrams from the middle of the beams, are enlarged, compared to the actual figures of the beams.

The exact form of the stress diagrams will depend on the relative effects of the construction qualities and the applied loads. The diagrams as shown, are only intended to illustrate the general stresses involved and how these change due to the different loads applied.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE PREFERRED EMBODIMENTS

Figures 1A, 1B, 1C:
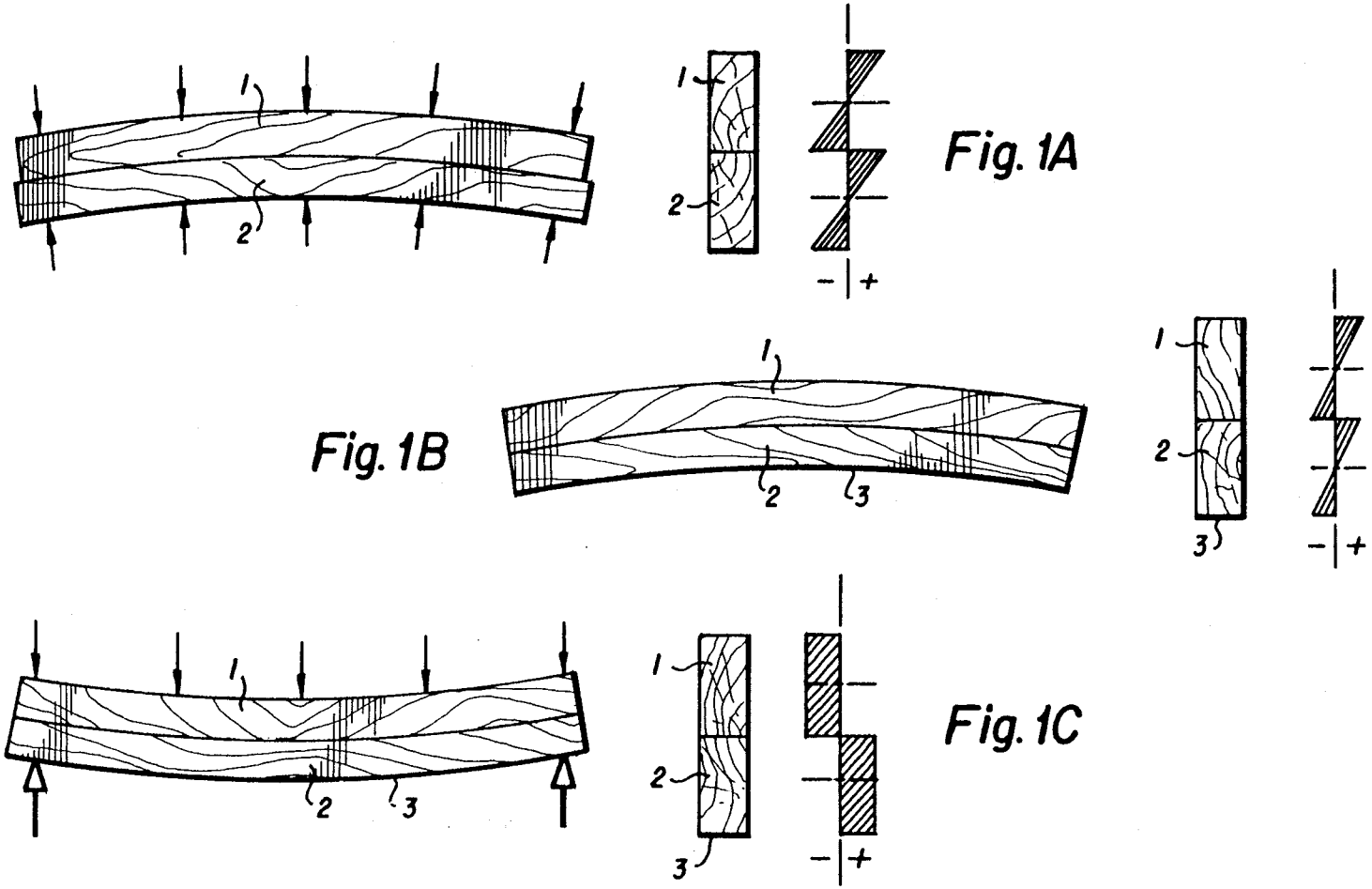
FIG. 1 shows two beams being deformed and curved in a press, while assembled by gluing.

FIG. 1A shows two beams, 1 and 2, for example laminated wooden beams, installed in a press and both deformed to the desired curvature. Originally curved beams can be given opposite curvatures in the press. The surfaces between the beams are coated with glue. The curvature introduces stresses in both beams, tension in the upper and compression in the lower part, as shown in the stress diagram.

FIG. 1B shows the glued beam unit 3, consisting of the beams 1 and 2, released from the press. The beams 1 and 2 retain the same type of stresses as before. These stresses, as introduced in beam unit 3, are retained permanently and are referred to as "pre-stresses."

FIG. 1C shows the assembled beam unit 3, under load as in practical use. The stresses are now changed. The original beam 1, is in compressional and the original beam 2, is in tensional stresses.

The constructional unit 3, assembled from beams 1 and 2, have a considerably higher bending capacity than an ordinary wooden beam of the same dimension. It is also clearly evident that the material in the middle of the cross-section of beam unit 3, is utilized in a highly effective manner. The stress diagram as shown, is the optimal situation.

Figures 2A, 2B, 2C:
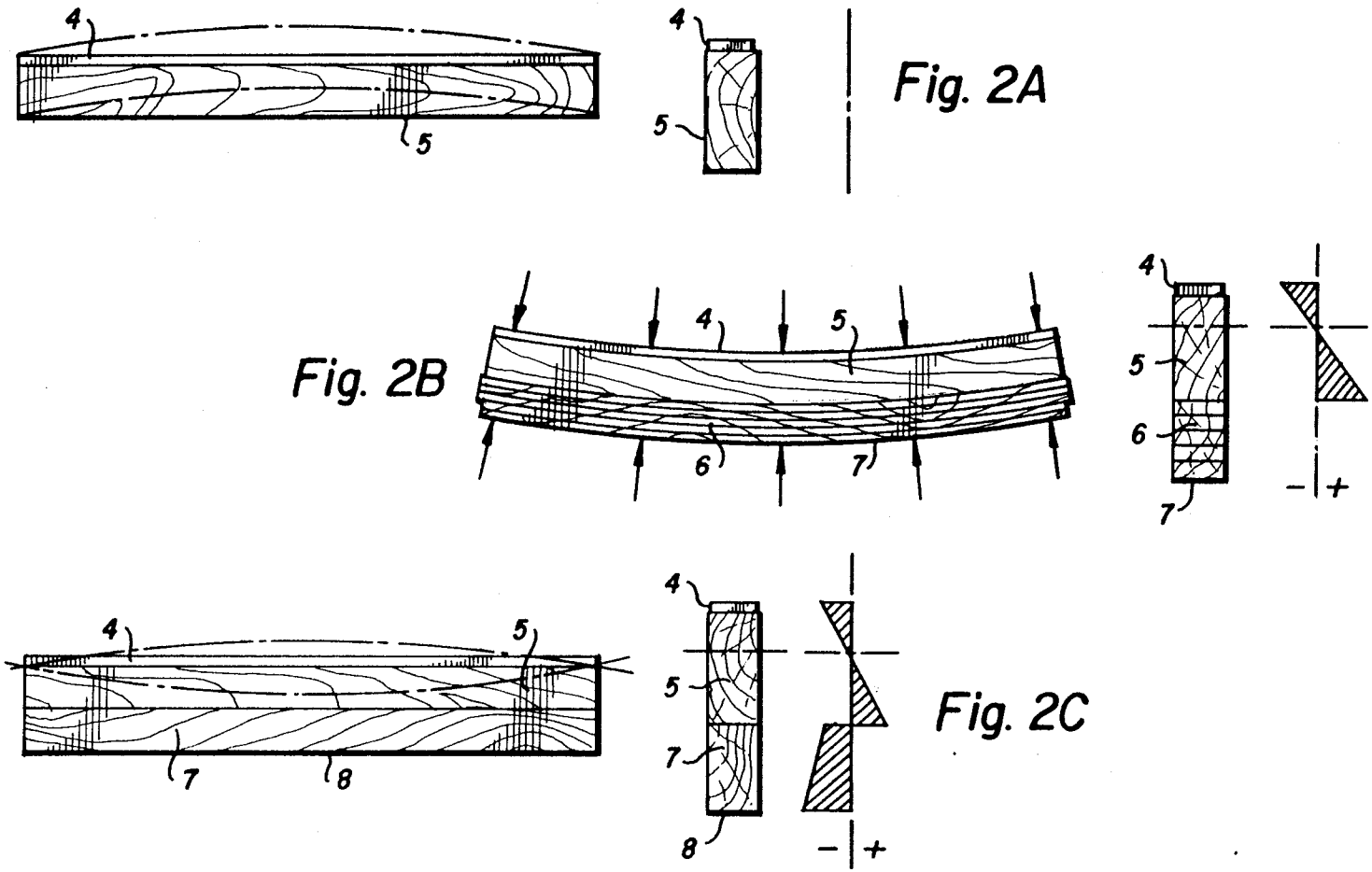
FIG. 2 shows a beam with a mounted reinforcing component, being curved in a press, while lamells are glued to the beam.

FIG. 2A shows a reinforcing component 4, for example of steel, mounted to the upper side of the structural part which is a laminated wooden beam 5.

FIG. 2B shows that beam 5, with reinforcing component 4, is being curved in a press in such a manner that beam 5 obtains a downward curvature, while another structural part 7, consisting of slender wooden lamells 6, is mounted to beam 5. When this beam, with the reinforcing component, is curved downward in the middle, compression stresses are introduced in the upper part and tension stresses in the lower part of beam 5. The neutral axis is shifted toward the reinforcing component 4.

FIG. 2C shows the structural unit 8, consisting of the structural parts 4,5 and 7, after unit 8, is removed from the press, after the glue has hardened. The reinforcing component 4 will be in compression, beam 5 will be in compression in the upper and in tension in the lower part, while part 7 will be in compression stresses, which increase downward to the lower side. The reinforcing component 4, in compression, definitely effects the pattern of pre-stresses which are introduced into the total structural unit, beam 8.

Figure 2D:
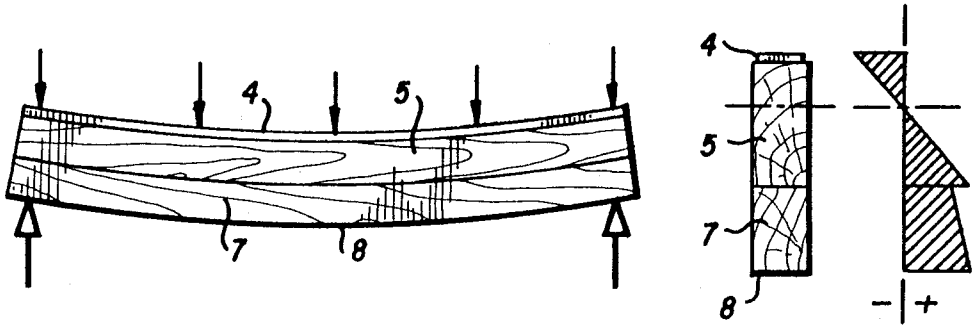

FIG. 2D, beam 8 is shown carrying loads as in practical use. These loads will bend the beam downward in the middle, which will increase compression in the upper part and tension in the lower part of part 5, while the stresses in part 7 will change from compression to tension. The reinforcing part 4, with increased compression stresses, is an important factor for increasing the stiffness of the total structural unit 8. Due to the introduced pre-stresses, the structural unit 8, will be capable of carrying increased loads and also have higher stiffness than an ordinary laminated wooden beam of the same dimension.

Figure 3A:
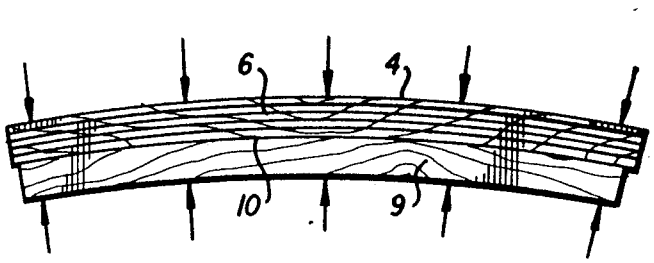
FIG. 3 shows a beam being curved in a press, while flexible lamells are glued on and reinforcing components are mounted.
Figure 3A:
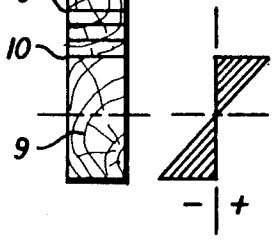

FIG. 3A shows a laminated beam 9, being curved upward in the middle, in a press. At the same time a number of slender lamells 6, are glued on, building up a new structural part 10, located on the upper side of beam 9. A reinforcing component 4, is also mounted to the upper side of the structural part 10. The structural part 9, receives the stresses compression in the upper and tension in the lower part.

Figure 3B:
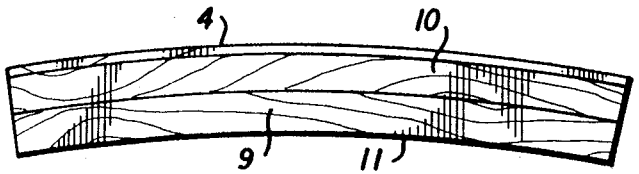

FIG. 3B shows that when the glue has hardened and the structural unit 11, consisting of the parts 9 and 10 and the reinforcing component 4, is removed from the press, the permanent pre-stresses are then introduced into the structural unit 11. These pre-stresses are introduced as tension in the upper and compression in the lower side of part 9, while part 10, receives compression which increases toward the lower area. The reinforcing component 4, is in compression.

Figure 3C:
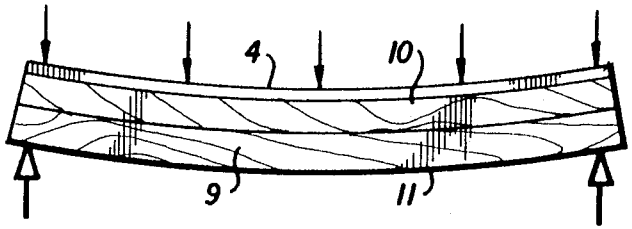
Figure 3C:
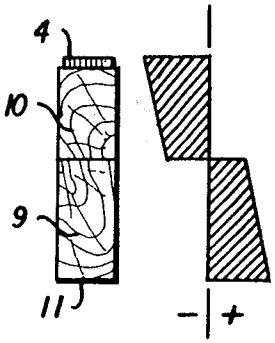

FIG. 3C shows the structural unit 11, under loads as in practical use. The reinforcing component 4 and part 10, will be in compression, while part 9 will receive tension stresses, increasing toward the lower side. The stress diagram shows that the volume of the material in the middle of the cross-section of unit 11, is utilized in a much more effective manner than otherwise would be the case in ordinary laminated wooden beams. In addition, the total structural unit 11, has a higher stiffness than a comparable ordinary beam.

Figure 4A:
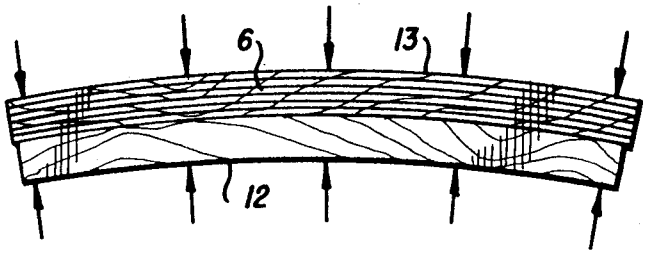
FIG. 4 shows a beam being curved in a press, while flexible lamells are glued on and reinforcing components are mounted at a later stage.

FIG. 4A shows a structural part 12, here represented as a laminated beam, placed in a press and curved upward in the middle, while by the use of glue, a number of wooden lamells 6, are mounted on the upper side of beam 12, thereby building up a new structural part 13. The beam 12, receives the stresses tension in the upper and compression in the lower part.

Figure 4B:
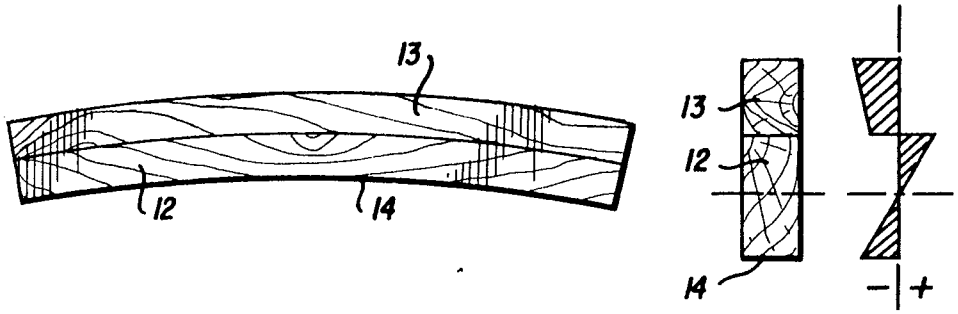

FIG. 4B shows that when the glue has hardened and the beam unit 14, consisting of parts 12 and 13, has been removed from the press, the permanent pre-stresses have then been introduced into beam 14. These pre-stresses are tension in the upper and compression in the lower area of part 12 and compression which increases in density toward the lower area of part 13.

FIG. 4C shows that a reinforcing component 4 is installed on the upper side of beam 14.

FIG. 4D shows beam unit 14, carrying loads, as in practical use. The upper part 13 and the reinforcing component 4, will receive introduced pre-stresses as compression, while the lower part 12, will have pre-stresses as tension. Also in this example, the stress diagram shows that the volume of material in the middle of the cross-section, again will be utilized with a very high degree of effectiveness. The total beam 14, will be able to carry higher loads and have a higher degree of stiffness than a comparable, ordinary laminated beam.

FIG. 5A shows a structural part, for example a laminated beam 15, curved upward in the middle in a press, at the same time as a reinforcing component 4, for example of steel, is mounted on the upper side. The beam 15 will obtain the pre-stresses tension in the upper and compression in the lower part.

Figure 5B:
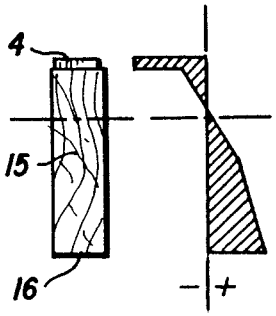
FIG. 5 shows a beam being curved in a press, while reinforcing components are mounted on the upper side.
Figure 5B:
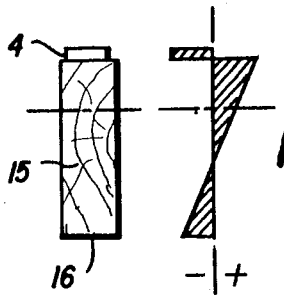

FIG. 5B shows that when beam unit 16, consisting of beam 15 and the reinforced component 4, is removed from the press, then permanent pre-stresses are introduced into beam unit 16, with the stresses compression in the reinforcing component 4, and tension in the upper and compression in the lower part of beam 15.

Figure 5C:
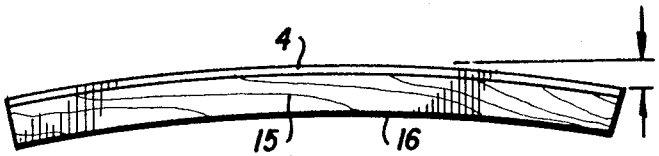
Figure 5C:
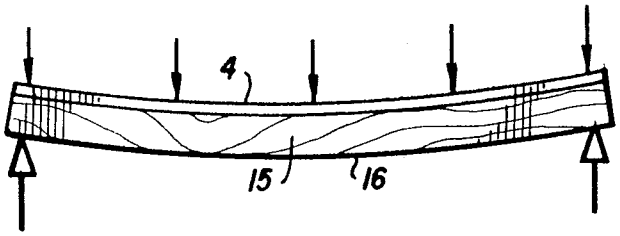

FIG. 5C shows that when beam 16, is subjected to heavy loads, the reinforcing component 4, will still be in compression while the stresses in beam 15 have changed to compression in a relatively small upper part and tension in the corresponding larger lower part. This structural beam 16, has a higher stiffness, can stand heavier loads and utilizes the volume of material definitely more effectively, than an ordinary laminated wooden beam of the same dimension.

Figure 6:
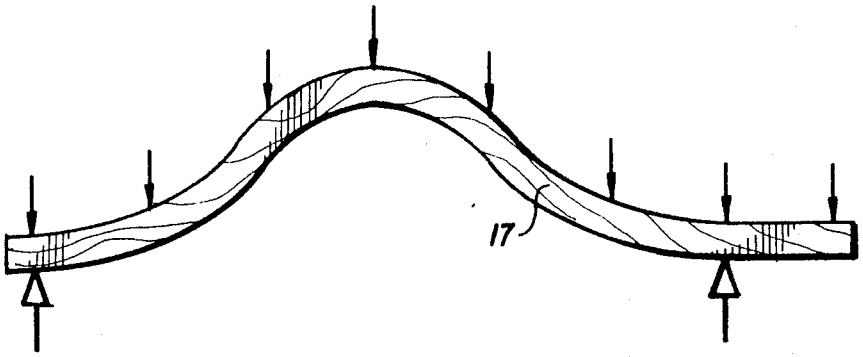
FIG. 6 shows a beam with different curvatures and varying stresses, over the total length of the beam.

FIG. 6 shows an example for one of many possible geometric shapes of structural constructions 17. Due to the shape, different loads and supports, the stresses in tension and compression will vary over the length of such constructions. Without showing this here in detail, it is obvious that the construction components described in the figures, can be assembled in various combinations to introduce pre-stresses in order to obtain the most efficient strength and stiffness in different parts of a construction formed as beam 17.

FIG. 7 shows several known methods for mounting reinforcing components 4, for example of steel, to structures 18, for example, laminated beams.

FIGS. 7, A, B, C and D shows methods utilizing bolts or screws 19, and glue 20.

FIGS. 7, E and F illustrates that a reinforcing component 4, does not necessarily have to be mounted on the extreme upper or lower side.

Figure 8:
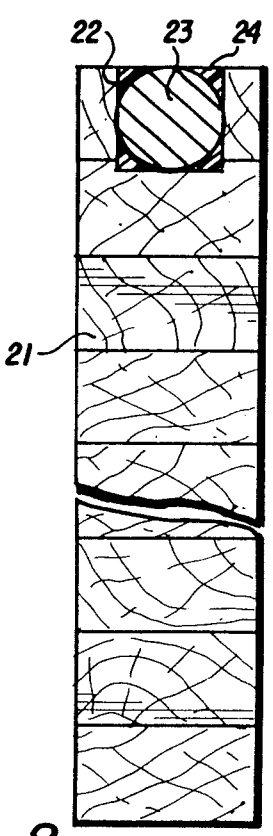
FIG. 8 is a cross-sectional view of one embodiment of the invention, in which the beam is reinforced with a steel rod.
Figure 7C:
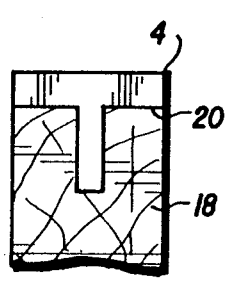
FIG. 7 shows examples of how reinforcing components, for example of steel, can be mounted to beams.
Figure 7F:
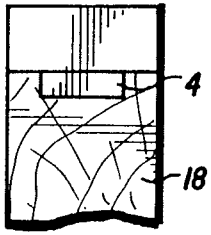
Figure 7B:
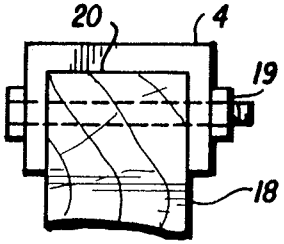
Figure 7E:
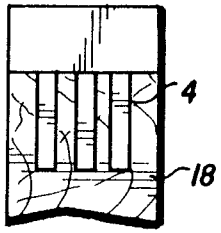
Figure 7A:
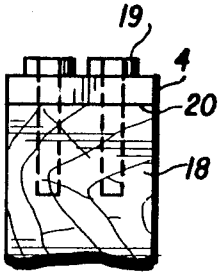
Figure 7D:
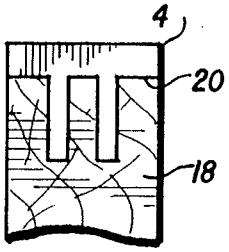

FIG. 8 illustrates a preferred embodiment of a reinforced beam in accordance with the invention. A laminated wood beam 21 is provided with a generally rectangularly shaped groove or recess 22 at one end of the beam 21, extending across the entire length of the beam. A steel rod 23 having a round cross-section is placed within groove 22 and extends along the entire length of beam 21. Steel rod 23 serves as the reinforcing element of beam 21 and is completely confined within groove 22, so that steel rod 23 is completely confined within the dimensions of beam 21. An epoxy resin 24 completely fills the area between rod 23 and groove 22 and bonds rod 23 to wooden beam 21.

In order to make the reinforced beam according to this embodiment, the laminated wooden beam 21 is placed in a press and prestressed so that the groove 22 is located along a curved convex tension side of the beam. While beam 21 is in the press, steel rod 23 and epoxy 24 are added and allowed to set. When beam 21 is removed from the press, steel rod or reinforcing element 23 is thus fixed to the curved convex tension side of the beam in its unloaded condition.

In additional embodiments of the invention, reinforcing element or components 4, 23 can be a polymeric material such as a thermosetting plastic, epoxy, polycarbonate, or a fiberglass-reinforced resin, concrete, reinforced concrete, or carbon or graphite filaments.

Although only preferred embodiments are specifically illustrated and described herein, it will be appreciated that many modifications and variations of the present invention are possible in light of the teachings and within the purview of the appended claims without departing from the spirit and intended scope of the invention.

What is claimed is:

1. In a device for load carrying structures comprising a prestressed reinforced beam of laminated wood having a longitudinal axis, the improvement comprising said reinforced laminated wood beam having a curved convex tension side and a curved concave compression side in its unloaded condition, the reinforcement of said beam comprising a longitudinally extending reinforcing element having a strength greater than wood and being fixed only to said curved convex tension side of said beam so that the longitudinal axes of said reinforcing element and said beam are parallel to one another.

2. The device of claim 1 wherein said reinforcing element is bonded to said convex tension side of said beam.

3. The device of claim 1 wherein said reinforcing element is affixed to said convex tension side of said beam by means of bolts or screws.

4. The device of claim 3 wherein said reinforcing element is bonded to said convex tension side of said beam.

5. The device of claim 1 wherein said reinforcing element comprises metal.

6. The device of claim 5 wherein said metal is steel.

7. The device of claim 1 wherein said reinforcing element comprises wood and metal.

8. The device of claim 7 wherein said metal is steel.

9. The device of claim 7 wherein said wood and steel are bonded to said convex tension side of said beam.

10. The device of claim 1 wherein said reinforcing element comprises a plurality of slender reinforcing elements.

11. The device of claim 1 wherein said reinforcing element comprises a polymeric material.

12. The device of claim 11 wherein said polymeric material is selected from a group consisting of thermosetting plastic, epoxy, polycarbonate and fiberglass-reinforced resin materials.

13. The device of claim 1 wherein said reinforcing element comprises concrete.

14. The device of claim 1 wherein said reinforcing element comprises reinforced concrete.

15. The device of claim 1 wherein said reinforcing element comprises carbon filaments.

16. The device of claim 1 wherein said reinforcing element comprises graphite filaments.

17. In a device for load carrying structures comprising a prestressed reinforced beam of laminated wood having a longitudinal axis, the improvement comprising said reinforced laminated wood beam having a curved convex tension side and a curved concave compression side in its unloaded condition, the reinforcement of said beam comprising a longitudinally extending reinforcing element having a strength greater than wood and being fixed only to said curved convex tension side of said beam so that the longitudinal axes of said reinforcing element and said beam are parallel to one another wherein a longitudinal groove is formed in said beam extending the entire length of said beam along its longitudinal axis at the curved convex tension side of the beam, and said reinforcing element is disposed within said groove.

18. The device of claim 11 wherein said reinforcing element is a round steel rod.

19. The device of claim 12 wherein an epoxy resin fills the space between said rod and said groove, bonding the rod to the beam.

20. The device of claim 13 wherein the groove and rod are so dimensioned that the rod is completely contained within the groove, so that the rod is completely contained within the dimensions of the beam.

21. The device of claim 11 wherein said reinforcing element comprises a polymeric material.

22. The device of claim 21 wherein said polymeric material is selected from a group consisting of thermosetting plastic, epoxy, polycarbonate and fiberglass-reinforced resin materials.

23. The device of claim 11 wherein said reinforcing element comprises concrete.

24. The device of claim 11 wherein said reinforcing element comprises reinforced concrete.

25. The device of claim 11 wherein said reinforcing element comprises carbon filaments.

26. The device of claim 11 wherein said reinforcing element comprises graphite filaments.

* * * * *

UNITED STATES PATENT AND TRADEMARK OFFICE

CERTIFICATE OF CORRECTION

PATENT NO. : 4,965,973

DATED : October 30, 1990

INVENTOR(S) : Arne ENGEBRETSEN

It is certified that error appears in the above-identified patent and that said Letters Patent is hereby corrected as shown below:

COL. 6, line 60

Claim 18, line 1, "claim 11-" should be --claim 17--.

line 62

Claim 19, line 1, "claim 12" should be --claim 18--.

line 65

Claim 20, line 1, "claim 13" should be --claim 19--.

Col. 7, line 1

Claim 21, line 1, "claim 11" should be --claim 17--.

Col. 8, line 1

Claim 23, line 1, "claim 11" should be --claim 17--.

UNITED STATES PATENT AND TRADEMARK OFFICE

CERTIFICATE OF CORRECTION

PATENT NO. : 4,965,973

DATED : October 30, 1990

INVENTOR(S) : Arne Engebretsen

It is certified that error appears in the above-identified patent and that said Letters Patent is hereby corrected as shown below:

Col. 8 line 3

Claim 24, line 1, "claim 11" should be --claim 17--.

line 5

Claim 25, line 1, "claim 11" should be --claim 17--.

line 7

Claim 26, line 1, "claim 11" should be --claim 17--.

Signed and Sealed this

Thirty-first Day of March, 1992

*Attest:*

HARRY F. MANBECK, JR.

*Attesting Officer*

*Commissioner of Patents and Trademarks*